US008846286B2

(12) United States Patent
Hobo et al.

(10) Patent No.: US 8,846,286 B2
(45) Date of Patent: Sep. 30, 2014

(54) LIQUID DEVELOPER, LIQUID DEVELOPING DEVICE, AND WET IMAGE FORMING METHOD

(75) Inventors: Jumpei Hobo, Osaka (JP); Katsuki Osanishi, Osaka (JP)

(73) Assignee: Kyocera Mita Corporation, Osaka-shi (JP)

( * ) Notice: Subject to any disclaimer, the term of this patent is extended or adjusted under 35 U.S.C. 154(b) by 307 days.

(21) Appl. No.: 13/114,538

(22) Filed: May 24, 2011

(65) Prior Publication Data

US 2011/0294065 A1 Dec. 1, 2011

(30) Foreign Application Priority Data

May 27, 2010 (JP) ..... 2010-121146

(51) Int. Cl.

| | |
|---|---|
| ***G03G 9/16*** | (2006.01) |
| ***G03G 13/22*** | (2006.01) |
| ***G03G 15/10*** | (2006.01) |
| ***G03G 9/13*** | (2006.01) |
| ***G03G 9/125*** | (2006.01) |
| ***G03G 9/12*** | (2006.01) |

(52) U.S. Cl.

CPC ..... *G03G 15/104* (2013.01); *G03G 9/131* (2013.01); *G03G 9/125* (2013.01); *G03G 9/132* (2013.01); *G03G 9/122* (2013.01)

USPC ..... 430/115; 430/112; 430/117.4; 399/237

(58) Field of Classification Search

CPC ..... G03G 9/16; G03G 12/22; G03G 15/10

USPC ..... 430/115, 112, 117.4; 399/237

See application file for complete search history.

(56) References Cited

U.S. PATENT DOCUMENTS

| | | | | |
|---|---|---|---|---|
| 2003/0186157 | A1 | 10/2003 | Teraoka et al. | |
| 2006/0024597 | A1 * | 2/2006 | Shoshi et al. | 430/73 |
| 2008/0101817 | A1 | 5/2008 | Oda et al. | |
| 2008/0227011 | A1 * | 9/2008 | Kuramoto et al. | 430/108.3 |
| 2010/0062361 | A1 | 3/2010 | Iwase | |

FOREIGN PATENT DOCUMENTS

| | | |
|---|---|---|
| EP | 0838731 A1 | 4/1998 |
| JP | 5-19538 | 1/1993 |
| JP | 10228135 | 8/1998 |
| JP | 10333366 | 12/1998 |
| JP | 2006184389 | 7/2006 |
| JP | 2008310021 | 12/2008 |
| JP | 2009157254 | 7/2009 |
| JP | 2009169262 | 7/2009 |
| JP | 201026309 | 2/2010 |
| JP | 201026311 | 2/2010 |
| JP | 201032689 | 2/2010 |

* cited by examiner

*Primary Examiner* — Mark F Huff
*Assistant Examiner* — Rachel Zhang
(74) *Attorney, Agent, or Firm* — Gerald E. Hespos; Michael J. Porco; Matthew T. Hespos

(57) ABSTRACT

In order to prevent the occurrence of bleeding in a nip between a photoreceptor and an intermediate transfer body or a nip between the photoreceptor and a sheet, which is a problem in a wet developing method, the present disclosure provides a liquid developer that includes an electrically insulating carrier liquid and colored particles dispersed within the carrier liquid, further contains an organic polymer compound, and has a viscosity of 30 to 400 mPa·s at a measurement temperature of 25° C.

14 Claims, 2 Drawing Sheets

LIQUID DEVELOPER, LIQUID DEVELOPING DEVICE, AND WET IMAGE FORMING METHOD

BACKGROUND OF THE INVENTION

1. Field of the Invention

The present disclosure relates to a technical field regarding a wet developing method, which is one of the electrophotographic systems that can be adopted in printers, copy machines, facsimile machines, or multi-functional peripherals having these functions.

2. Description of the Related Art

Developing systems used in an electrophotographic method for rendering an electrostatic latent image with electrically charged colored particles are generally classified roughly into a dry developing method and a wet developing method, depending on the type of the developer used. The wet developing method uses a liquid developer having colored particles dispersed within an electrically insulating carrier liquid. The colored particles electrically charged within the liquid developer moves from a developing roller surface to a photoreceptor drum surface according to the principle of electrophoresis, in order to render an electrostatic latent image on the photoreceptor drum surface into a toner image. The obtained toner image is transferred from the photoreceptor drum to a recording medium. The colored particles of the liquid developer are hardly scattered into the atmosphere, and therefore fine particles with, for example, submicron-sized average particle diameter can be used. Thus, high-quality, high-resolution images with excellent gradation can be obtained.

When an image forming apparatus using the wet developing method is continuously driven without printing anything or to print very few, the carrier liquid accumulates in a nip between the photoreceptor and an intermediate transfer body (intermediate transfer system) or a nip between the photoreceptor and a sheet (direct transfer system), causing bleeding. The bleeding is particularly noticeable when starting to drive the image forming apparatus, or between sheets when the image forming apparatus is used for continuous printing, because the entire image surface is a non-image area in those cases.

As a way to prevent the occurrence of bleeding, there has been reported technology for stabilizing the dispersion of a liquid toner by using a specific pigment, so as to prevent bleeding in images.

This conventional method, however, cannot use different-colored pigments other than a specific pigment because the use of other pigments still causes the bleeding. An object of the present disclosure is to provide a liquid developer, a liquid developing device, a wet image forming apparatus, and a wet image forming method, which are capable of preventing the occurrence of bleeding even when using a variety of pigments.

SUMMARY OF THE INVENTION

As a result of a dedicated study in view of the object described above, the inventors of the present disclosure have focused on that the bleeding in images can be prevented by including an organic polymer compound into a liquid developer and adjusting the viscosity of the liquid developer to a predetermined viscosity, and completed the present disclosure through further researches.

Specifically, one aspect of the present disclosure for accomplishing the object described above is a liquid developer that includes an electrically insulating carrier liquid, colored particles dispersed within the carrier liquid, and an organic polymer compound, and has a viscosity of 30 to 400 mPa·s at a measurement temperature of 25° C.

Another aspect of the present disclosure for accomplishing the object described above is a liquid developing device for developing an electrostatic latent image on a surface of a photoreceptor drum by using a liquid developer, wherein the liquid developing device uses, as the liquid developer, a liquid developer that includes an electrically insulating carrier liquid, colored particles dispersed within the carrier liquid, and an organic polymer compound, and has a viscosity of 30 to 400 mPa·s (at a measurement temperature of 25° C.).

Yet another aspect of the present disclosure for accomplishing the object described above is a wet image forming apparatus, having: a charger for charging a surface of a photoreceptor drum; an exposure device for forming an electrostatic latent image on the charged surface of the photoreceptor drum; a liquid developing device for developing the electrostatic latent image on the surface of the photoreceptor drum by using a liquid developer; and a transfer device for transferring (directly or indirectly) the developed image to a recording medium, wherein the wet image forming apparatus uses, as the liquid developer, a liquid developer that includes an electrically insulating carrier liquid, colored particles dispersed within the carrier liquid, and an organic polymer compound, and has a viscosity of 30 to 400 mPa·s (at a measurement temperature of 25° C.).

Yet another aspect of the present disclosure for accomplishing the object described above is a wet image forming method, having: a charging step of charging a surface of a photoreceptor drum; an exposure step of forming an electrostatic latent image on the charged surface of the photoreceptor drum; a developing step of developing the electrostatic latent image on the surface of the photoreceptor by using a liquid developer that includes an electrically insulating carrier liquid, colored particles dispersed within the carrier liquid, and an organic polymer compound, and has a viscosity of 30 to 400 mPa·s (at a measurement temperature of 25° C.); a transfer step of transferring the developed image to a recording medium; and a discharge step of discharging the recording medium having the image transferred thereto, to a discharge part.

DETAILED DESCRIPTION OF THE PREFERRED EMBODIMENTS

<Liquid Developer>

Figure 1:
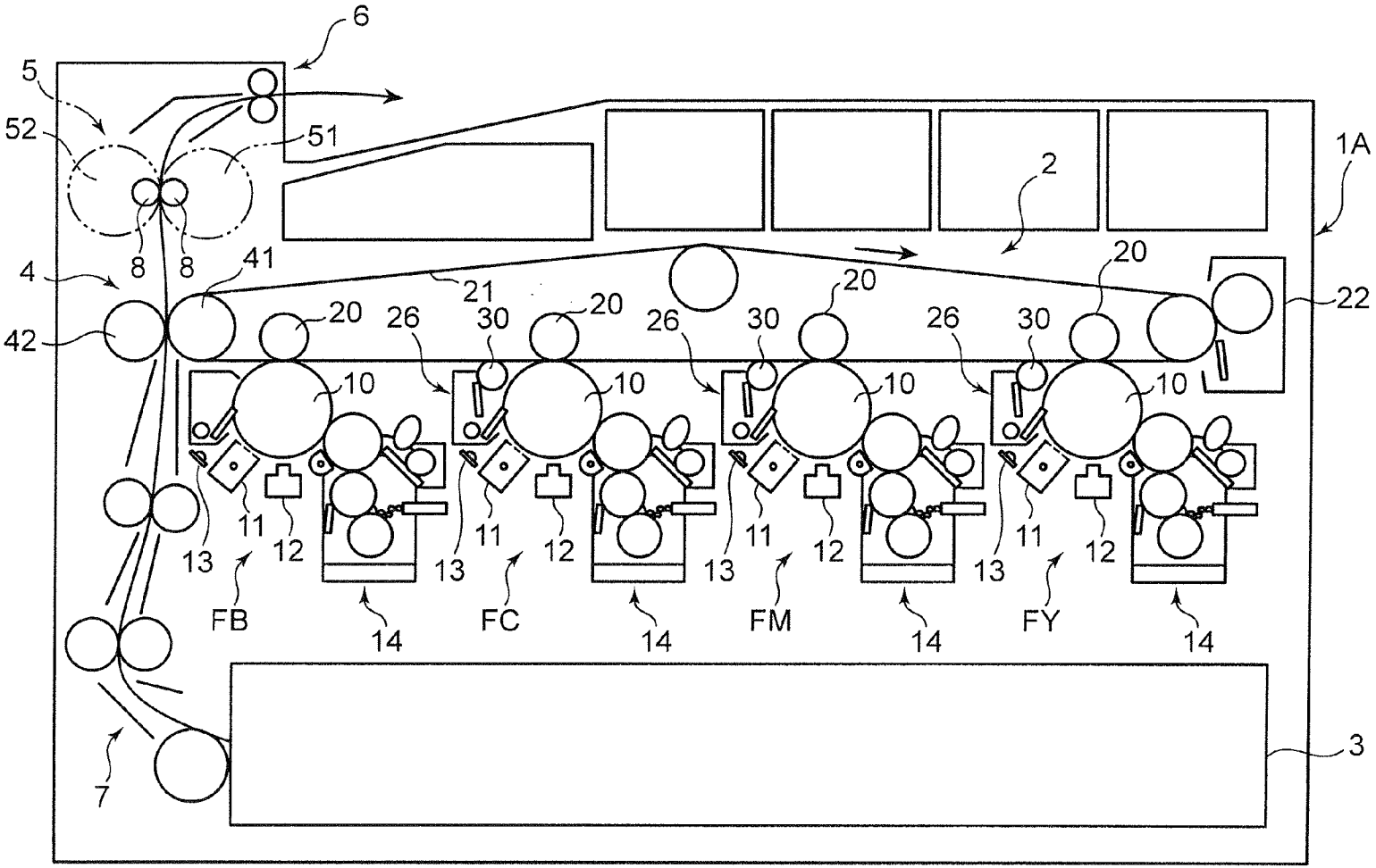
FIG. 1 is a schematic configuration diagram of a wet image forming apparatus according to an embodiment of the present disclosure.

The basic components of a liquid developer according to the present embodiment are an electrically insulating carrier liquid and colored particles dispersed within the carrier liquid. This liquid developer is characterized in containing an organic polymer compound and has a viscosity of 30 to 400 mPa·s at a measurement temperature of 25° C. The viscosity (at the measurement temperature of 25° C.) is preferably 40 to 300 mPa·s, and more preferably 50 to 250 mPa·s.

[Carrier Liquid]

An electrically insulating carrier liquid generally plays a role of a liquid carrier and is used for the purpose of enhancing electrical insulation of a liquid developer to be obtained. For example, an electrically insulating organic solvent having a volume resistivity of $10^{12}$ Ω·cm or above at 25° C. (i.e., an electrical conductivity of 1.0 pS/cm or lower) is preferably used as the electrically insulating carrier liquid. In addition, a carrier liquid which further can dissolve organic polymer compounds described hereinafter is preferably used (the one with relatively high solubility for the organic polymer compounds).

It should be noted that the viscosity and type of the carrier liquid as well as the compounding amount therein need to be appropriately adjusted and selected in order to obtain the 30 to 400 mPa·s viscosity (at the measuring temperature of 25° C.) in the entire liquid developer. Because the viscosity of the liquid developer varies depending on a combination of the organic solvent used as the carrier liquid and the organic polymer compound, described hereinafter, the type and compounding amount of the organic solvent need to be appropriately determined in accordance with a desired viscosity of the liquid developer and the type of organic polymer compounds to be selected.

Examples of such an electrically insulating organic solvent include aliphatic hydrocarbons that are liquid at ordinary temperature, and vegetable oil.

Examples of the aliphatic hydrocarbons include liquid n-paraffinic hydrocarbons, iso-paraffinic hydrocarbons, halogenated aliphatic hydrocarbons, branched aliphatic hydrocarbons, and a mixture thereof. More specifically, n-hexane, n-heptane, n-octane, nonane, decane, dodecane, hexadecane, heptadecane, cyclohexane, perchloroethylene, trichloroethane, and the like can be used. From the perspective of environmental responsiveness (VOC measures), a nonvolatile organic solvent and an organic solvent of relatively low volatility (with, for example, a boiling point of 200° C. or higher) are preferred. In addition, liquid paraffins that include relatively large amount of aliphatic hydrocarbon with 16 or more carbon atoms can be preferably used.

Specific examples of the vegetable oil include tall oil fatty acid (major components: oleic acid, linoleic acid), vegetable oil-based fatty acid ester, soybean oil, sunflower oil, castor oil, flaxseed oil, and tung oil. Above all, tall oil fatty acid and the like are preferably used.

A commercially available carrier liquid may be used as the carrier liquid, and examples thereof include liquid paraffins "Moresco White P-55," "Moresco White P-40," "Moresco White P-70," and "Moresco White P-200" manufactured by Matsumura Oil Co., Ltd.; tall oil fatty acids "Hartall FA-1," "Hartall FA-1P," and "Hartall FA-3" manufactured by Harima Chemicals, Inc.; vegetable oil-based solvents "Vege-Sol™ MT," "Vege-Sol™ CM," "Vege-Sol™ MB," "Vege-Sol™ PR," and tung oil manufactured by Kaneda Co., Ltd.; "Isopar™ G," "Isopar™ H," "Isopar™ K," "Isopar™ L," "Isopar™ M," and "Isopar™ V" manufactured by ExxonMobil Corporation; liquid paraffins "Cosmo White P-60," "Cosmo White P-70," and "Cosmo White P-120" manufactured by Cosmo Oil Co., Ltd.; vegetable oils "refined soybean oil S," "flaxseed oil," and "sunflower oil" manufactured by The Nisshin Oillio Group, Ltd.; and "castor oil LAV" and "castor oil I" manufactured by Ito Oil Chemicals Co., Ltd.

In the present embodiment, any carrier liquid may be used as long as it dissolves the organic polymer compounds. In other words, the one with relatively high solubility for the organic polymer compounds (the one that dissolves the organic polymer compounds successfully) may be used alone as the carrier liquid, or it may be combined with the one with relatively low solubility for the organic polymer compounds (the one that poorly dissolves the organic polymer compounds). In this case, it should be noted that the electrical conductivity of the entire carrier liquid to be used or the electrical conductivity of the liquid developer should not be excessively high according to the type of the carrier liquid to be used. For instance, vegetable oils such as tall oil fatty acids generally have higher electrical conductivities than the aliphatic hydrocarbons such as liquid paraffins. For this reason, when the above-described oils are included as the carrier liquid in order to successfully dissolve the organic polymer compounds in the carrier liquid, attention needs to be paid to the contained amount of the above-described oils.

The greater the content of the oils in the entire carrier liquid, the better in terms of the solubility for the organic polymer compounds but the worse in terms of the electrical conductivity. The lower the content of the oils in the entire carrier liquid, the better in terms of the electrical conductivity but the worse in terms of the solubility for the organic polymer compounds.

As described above, the content of the above-described oils in the entire carrier liquid depends on the type and content, of the organic polymer compounds included in the liquid developer, and is preferably, for example, 2 to 80 mass %, and more preferably 5 to 60 mass %. It is difficult to successfully dissolve the organic polymer compounds in the carrier liquid when the content of the oils is less than 2 mass %. The electrical conductivity of the entire carrier liquid or the electrical conductivity of the liquid developer becomes excessively high when the content of the oils exceeds 80 mass %. Excessively high electrical conductivity of the liquid developer leads to poor developing properties, low image density, and high risk of fogging.

In the present embodiment, the electrical conductivity of the liquid developer is preferably, for example, 200 pS/cm or lower. Therefore, the electrical conductivity of the entire carrier liquid or the electrical conductivity of the liquid developer is preferably adjusted to, for example, 200 pS/cm or lower by dissolving the organic polymer compounds in the oils such as tall oil fatty acids and then mixing a highly electrically resistant aliphatic hydrocarbon with thus obtained solution (often referred to as "resin solvent" hereinafter in the present specification).

[Colored Particles]

As colored particles, the present embodiment may use a well-known toner that is obtained by dispersing pigments in binder resins. Preferably, pigments are used as the colored particles. By using the liquid developer of the present disclosure, pigments itself can be included in the liquid developer and thus a thermal fixation process required when using a toner containing a binding resin can be skipped in order to perform image formation. In other words, the pigments serving as the colored particles can be fixed onto a recording medium without consuming thermal energy or light energy, and consequently the consumption energy of the wet image forming apparatus can be reduced.

For example, conventionally known organic pigments or inorganic pigments can be used as the pigments of the present embodiment without any limitation.

Examples of a black pigment include azine dyes such as carbon black, oil furnace black, channel black, lampblack, acetylene black, and aniline black, metal salt azo dyes, metallic oxides, and combined metal oxides. Examples of a yellow pigment include cadmium yellow, mineral fast yellow, nickel titanium yellow, navels yellow, naphthol yellow S, hansa yellow G, hansa yellow 10G, benzidine yellow GR, quinoline yellow lake, permanent yellow NCG, and tartrazine lake. Examples of an orange pigment include molybdenum orange, permanent orange GTR, pyrazolone orange, Vulcan orange, indanthrene brilliant orange RK, benzidine orange G, and indanthrene brilliant orange GK. Examples of a red pigment include colcothar, cadmium red, permanent red 4R, lithol red, pyrazolone red, watching red calcium salt, lake red D, brilliant carmine 6B, eosin lake, rhodamine lake B, alizarin lake, and brilliant carmine 3B. Examples of a purple pigment include fast violet B and methyl violet lake. Examples of a blue pigment include C.I. Pigment Blue 15:3, cobalt blue, alkali blue, Victoria blue lake, phthalocyanine blue, non-metal phthalocyanine blue, partial chloride of phthalocyanine blue, fast sky blue, and indanthrene blue BC. Examples of a green pigment include chrome green, chromium oxide, pigment green B, and malachite green lake.

The content of pigment(s) in the liquid developer is preferably 1 to 30 mass %, more preferably 3 mass % or more, and more preferably 5 mass % or more. The content of pigment(s) is also more preferably 20 mass % or less, and more preferably 10 mass % or less.

An average particle diameter of each pigment within the liquid developer, which is a volume basis median diameter ($D_{50}$) is preferably 0.1 to 1.0 μm. The average particle diameter less than 0.1 μm leads to low image density and high risk of fogging due to poor developing properties. The average particle diameter above 1.0 μm leads to low fixation properties. The volume basis median diameter ($D_{50}$) here generally denotes a particle diameter at the point where a cumulative curve based on the total volume 100% of one group of particles with a determined particle distribution attains 50%.

[Dispersion Stabilizer]

The liquid developer according to the present embodiment may contain a dispersion stabilizer for promoting and stabilizing the dispersion of the particles (pigments) within the liquid developer. A dispersion stabilizer "BYK-116" manufactured by BYK Co., Ltd., for example, can be suitably used as the dispersion stabilizer according to the present embodiment. In addition, "Solsperse 9000," "Solsperse 11200," "Solsperse 13940," "Solsperse 16000," "Solsperse 17000, and "Solsperse 18000" manufactured by The Lubrizol Corporation, and "Antaron™ V-216" and "Antaron™ V-220" manufactured by International Specialty Products, Inc. can be preferably used.

The content of the dispersion stabilizer within the liquid developer is approximately 1 to 10 mass %, and preferably 2 to 6 mass %.

[Organic Polymer Compounds]

The liquid developer according to the present embodiment contains organic polymer compounds. Because simply increasing the viscosity of the liquid developer is not enough to prevent the occurrence of bleeding, adding organic polymer compounds to the liquid developer can achieve sufficient effects, as will be described in the following embodiments.

Any organic polymer compounds can be used without limitation as long as they can dissolve in the carrier liquid, increase the viscosity of the liquid developer, and prevent the occurrence of bleeding during image formation. Specific examples of such organic polymer compounds include a cyclic olefin copolymer, styrene elastomer, cellulose ether, and polyvinyl butyral. Preferably, the use of styrene elastomer can obtain excellent effects. These organic polymer compounds can be used alone or in combination of two or more.

The liquid developer of the present embodiment has the organic polymer compounds dissolved in the carrier liquid. This means that the carrier liquid contains gel-like organic polymer compounds as well. Depending on the types and molecular weights of the organic polymer compounds, the organic polymer compounds may become mutually entwined and form a gel having a relatively low fluidity. For example, when concentrations of the organic polymer compounds is high or when affinity of the organic polymer compounds for the carrier liquid is low or when the ambient temperature is low, the organic polymer compounds may form a gel. On the other hand, when the organic polymer compounds hardly entwine mutually in the carrier liquid and hence are relatively fluid, the carrier liquid is in the form of solution.

The content of the organic polymer compounds is preferably, for example, 1 to 10 mass % but varies depending on the types thereof.

When the content of the organic polymer compounds is less than 1 mass %, sufficient viscosity cannot be obtained in the liquid developer, which might not be able to effectively prevent the occurrence of bleeding during image formation (on formed images). The content of the organic polymer compounds exceeding 10 mass % leads to the formation of an excessively thick film of the organic polymer compounds on a surface of a sheet, deteriorating the drying characteristics of the film, increasing the adherence (tackiness) of the film, and lowering a scratch resistance of the image. The content of the organic polymer compounds exceeding 10 mass % also leads to poor developing properties, resulting in low image density and high risk of fogging.

The organic polymer compounds that can be used in the present embodiment are described hereinafter in more detail.

(Cyclic Olefin Copolymer)

A cyclic olefin copolymer is an amorphous, thermoplastic cyclic olefin resin that has a cyclic olefin skeleton in its main chain, has no environmental load substance and is excellent in transparency, lightweight properties, and low water absorption properties. More specifically, the cyclic olefin copolymer of the present embodiment is a polymer compound that has a main chain composed of a carbon-carbon bond, in which at least a part of the main chain has a cyclic hydrocarbon structure. The cyclic hydrocarbon structure is introduced by using, as a monomer, a compound having at least one olefinic double bond in the cyclic hydrocarbon structure (cyclic olefin), such as norbornene and tetracyclododecene.

The conditions for the cyclic olefin copolymer that can be used in the present embodiment are: the cyclic olefin copolymer can stably exist in a dissolved state in the carrier liquid for a long period of time; and the cyclic olefin copolymer can accumulate and then form a film on the surface of the sheet when the concentration of the cyclic olefin copolymer within the carrier liquid increases and consequently exceeds the saturated amount of the dissolved cyclic olefin copolymer on the surface of the sheet after the image is transferred to the sheet. Thus, examples of the cyclic olefin copolymer that can be used in the present embodiment include (1) cyclic olefin-based addition (co) polymer or its hydrogenated product, (2) an addition copolymer of a cyclic olefin and an α-olefin, or its hydrogenated product, and (3) a cyclic olefin-based ring-opening (co) polymer or its hydrogenated product.

Specific examples of the cyclic olefin copolymer are as follows:

(a) Cyclopentene, cyclohexane, cyclooctene;

(b) Cyclopentadiene, 1,3-cyclohexadiene and other one-ring cyclic olefins;

(c) Bicyclo[2.2.1]hept-2-ene (norbornene), 5-methyl-bicyclo[2.2.1]hept-2-ene, 5,5-dimethyl-bicyclo[2.2.1]hept-2-ene, 5-ethyl-bicyclo[2.2.1]hept-2-ene, 5-butyl-bicyclo[2.2.1]hept-2-ene, 5-ethylidene-bicyclo[2.2.1]hept-2-ene, 5-hexyl-bicyclo[2.2.1]hept-2-ene, 5-octyl-bicyclo[2.2.1]

hept-2-ene, 5-octadecyl-bicyclo[2.2.1]hept-2-ene, 5-methylidene-bicyclo[2.2.1]hept-2-ene, 5-vinyl-bicyclo[2.2.1]hept-2-ene, 5-propenyl-bicyclo[2.2.1]hept-2-ene, and other two-ring cyclic olefins;

(d) Tricyclo[4.3.0.12,5]dec-3,7-diene (dicyclopentadiene), tricyclo[4.3.0.12,5]dec-3-ene;

(e) Tricyclo[4.4.0.12,5]undec-3,7-diene or tricyclo[4.4.0.12,5]undec-3,8-diene or tricyclo[4.4.0.12,5]undec-3-ene that is a partially hydrogenated product (or an adduct of cyclopentadiene and cyclohexane) thereof;

(f) 5-cyclopentyl bicyclo[2.2.1]hept-2-ene, 5-cyclohexyl-bicyclo[2.2.1]hept-2-ene, 5-cyclohexenyl bicyclo[2.2.1]hept-2-ene, 5-phenyl-bicyclo[2.2.1]hept-2-ene, and other three-ring cyclic olefins;

(g) Tetracyclo[4.4.0.12,5.17,10]dodec-3-ene (tetracyclododecene), 8-methyltetracyclo[4.4.0.12,5.17,10]dodec-3-ene, 8-ethyltetracyclo[4.4.0.12,5.17,10]dedec-3-ene, 8-methylidenetetracyclo[4.4.0.12,5.17,10]dedec-3-ene, 8-ethylidenetetracyclo[4.4.0.12,5.17,10]dodec-3-ene, 8-vinyltetracyclo[4.4.0.12,5.17,10]dodec-3-ene, 8-propenyl-tetracyclo[4.4.0.12,5.17,10]dodec-3-ene, and other four-ring cyclic olefins;

(h) 8-cyclopentyl-tetracyclo[4.4.0.12,5.17,10]dodec-3-ene, 8-cyclohexyl-tetracyclo[4.4.0.12,5.17,10]dodec-3-ene, 8-cyclohexenyl-tetracyclo[4.4.0.12,5.17,10]dodec-3-ene, and 8-phenyl-cyclopentyl-tetracyclo[4.4.0.12,5.17,10]dodec-3-ene;

(i) Tetracyclo[7.4.13,6.01,9.02,7]tetradeca-4,9,11,13-tetraene (1,4-methano-1,4,4a,9a-tetrahydrofluorene), tetracyclo [8.4.14,7.01,10.03,8]pentadeca-5,10,12,14-tetraene (1,4-methano -1,4,4a,5,10,10a-hexahydroanthracene);

(j) Pentacyclo[6.6.1.13,6.02,7.09,14]-4-hexadecene, pentacyclo [6.5.1.13,6.02,7.09,13]-4-pentadecene, pentacyclo [7.4.0.02,7.13,6.110,13]-4-pentadecene, heptacyclo [8.7.0.12, 9.14,7.111,17.03,8.012,16]-5-eicosene, heptacyclo [8.7.0.12, 9.03,8.14,7.012,17.113,16]-14-eicosene; and (k) Polycyclic olefins such as tetramers of cyclopentadiene. These cyclic olefins may be used alone or in combinations of two or more thereof.

The α-olefin has 2 to 20 carbon atoms, and preferably 2 to carbon atoms. Specific examples thereof include ethylene, propylene, 1-butene, 1-pentene, 1-hexene, 3-methyl-1-butene, 3-methyl-1-pentene, 3-ethyl-1-pentene, 4-methyl-1-pentene, 4-methyl -1-hexene, 4,4-dimethyl-1-hexene, 4,4-dimethyl-1-pentene, 4-ethyl -1-hexene, 3-ethyl-1-hexene, 1-octene, 1-decene, 1-dodecene, 1-tetradecene, 1-hexadecene, 1-octadecene, and 1-eicosene. These α-olefins can be used alone or in combinations of two or more thereof.

A method for polymerizing cyclic olefins, a method for polymerizing cyclic olefins with α-olefins, and a method for hydrogenating the resultant polymer are not particularly limited and can be carried out according to well-known methods.

The structure of the cyclic olefin copolymer is not particularly limited and may be linear, branched or crosslinked. In the present embodiment, the cyclic olefin copolymer is preferably linear.

In the present embodiment, a copolymer of norbornene and ethylene, or of tetracyclododecene and ethylene can be preferably used as the cyclic olefin copolymer, and the copolymer of norbornene and ethylene is more preferred. In this case, the content of norbornene in the copolymer is preferably 60 to 82 mass %, more preferably 60 to 79 mass %, yet more preferably 60 to 76 mass %, and most preferably 60 to 65 mass %. When the content of norbornene is less than 60 mass %, the glass transition temperature of the film of the cyclic olefin copolymer may become excessively low, which may lead to a risk of lowering film formation properties of the cyclic olefin copolymer. When the content of norbornene exceeds 82 mass %, the glass transition temperature of the film of the cyclic olefin copolymer may become excessively high, which may lead to a risk of lowering fixation properties of the pigments, that is, fixation properties of images by the film of the cyclic olefin copolymer. It also may significantly reduce the solubility of the cyclic olefin copolymer for the carrier liquid.

In the present embodiment, a commercially available cyclic olefin copolymer can be used. Examples of the copolymer of norbornene and ethylene include "TOPAS™" (norbornene content: approximately 60 mass %), "TOPAS™" TB" (norbornene content: approximately 60 mass %), "TOPAS™ 8007" (norbornene content: approximately 65 mass %), "TOPAS™ 5013" (norbornene content: approximately 76 mass %), "TOPAS™ 6013" (norbornene content: approximately 76 mass %), "TOPAS™ 6015" (norbornene content: approximately 79 mass %), and "TOPAS™ 017" (norbornene content: approximately 82 mass %), which are manufactured by TOPAS Advanced Polymers GmbH. These copolymers may be used alone or in combinations of two or more thereof, depending on the circumstances.

(Styrene Elastomer)

A conventionally known styrene elastomer can be used as the styrene elastomer available in the present embodiment. Specific examples thereof include a block copolymer composed of an aromatic vinyl compound and a conjugated diene compound or olefinic compound. Examples of the block copolymer include a block copolymer that has a structure expressed by Formula 1 where A is a polymer block composed of an aromatic vinyl compound and B is a polymer block composed of an olefinic compound or conjugated diene compound.

(CHEMICAL FORMULA 1)

$$[A—B]_x—A \quad [C1]$$

(WHERE x REPRESENTS AN INTEGER CHOSEN SUCH THAT THE NUMBER AVERAGE MOLECULAR WEIGHT RANGES FROM 1,000 TO 100,00.)

Examples of the aromatic vinyl compound constituting the block copolymer include styrene, α-methylstyrene, o-methylstyrene, m-methylstyrene, p-methylstyrene, 2,3-dimethylstyrene, 2,4-dimethylstyrene, monochlorostyrene, dichlorostyrene, p -bromostyrene, 2,4,5-tribromostyrene, 2,4,6-tribromostyrene, o -tert-butylstyrene, m-tert-butylstyrene, p-tert-butylstyrene, ethylstyrene, vinylnaphthalene, and vinylanthracene.

The polymer block A may be composed of one or two or more types of the aromatic vinyl compounds described above. Of these aromatic vinyl compounds, the one composed of styrene and/or α-methylstyrene provides properties suitable for the liquid developer of the present embodiment.

Examples of the olefinic compound constituting the block copolymer include ethylene, propylene, 1-butene, 2-butene, isobutene, 1-pentene, 2-pentene, cyclopentene, 1-hexene, 2-hexene, cyclohexene, 1-heptene, 2-heptene, cycloheptene, 1-octene, 2-octene, cyclooctene, vinylcyclopentene, vinylcyclohexene, vinylcycloheptene, and vinylcyclooctene.

Examples of the conjugated diene compound constituting the block copolymer include butadiene, isoprene, chloroprene, 2,3-dimethyl-1,3-butadiene, 1,3-pentadien, and 1,3-hexadien.

The polymer block B may be composed of one or two or more types of each of the olefinic compounds and/or the conjugated diene compounds. Of these compounds, the one composed of butadiene and/or isoprene provides the properties suitable for the liquid developer of the present embodiment.

Specific examples of the block copolymer include a polystyrene-polybutadiene-polystyrene triblock copolymer or its hydrogenated product, polystyrene-polyisoprene-polystyrene triblock copolymer or its hydrogenated product, polystyrene-poly(isoprene/butadiene)-polystyrene triblock copolymer or its hydrogenated product, poly(α-methylstyrene)-polybutadiene-poly(α-methylstyrene) triblock copolymer or its hydrogenated product, poly(α-methylstyrene)-polyisoprene-poly(α-methylstyrene) triblock copolymer or its hydrogenated product, poly α-methylstyrene)-poly(isoprene/butadiene)-poly(α-methylstyrene) triblock copolymer or its hydrogenated product, polystyrene -polyisobutene-polystyrene triblock copolymer, and poly(α-methylstyrene)-polyisobutene-poly(α-methylstyrene) triblock copolymer.

As the styrene elastomer that can be used in the present embodiment, it is preferred to use a styrene-butadiene elastomer (SBS) that has a structure in which the polymer block A and polymer block B are expressed by Formula 2.

(CHEMICAL FORMULA 2)

[C2]

POLYMER BLOCK A POLYMER BLOCK B

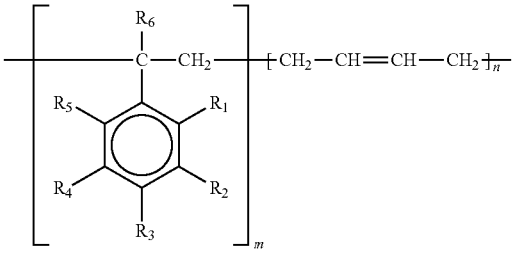

(WHERE $R_1$, $R_2$, $R_4$, $R_5$ AND $R_6$ EACH REPRESENT A HYDROGEN ATOM OR METHYL; $R_3$ REPRESENTS A HYDROGEN ATOM, A HALOGEN ATOM, A PHENYL GROUP OR A SATURATED ALKYL GROUP, METHOXY GROUP OR ETHOXY GROUP HAVING 1 TO 20 CARBON ATOMS; AND m, n EACH REPRESENT AN INTEGER CHOSEN SUCH THAT THE CONTENT OF THE POLYMER BLOCK A RANGES FROM 5 TO 75 mass %.)

The styrene-butadiene elastomer is obtained by copolymerizing styrene monomer and butadiene, which is the conjugated diene compound. Examples of preferred styrene monomer include styrene, α-methylstyrene, o-methylstyrene, m-methylstyrene, p-methylstirene, p-ethylstyrene, 2,4-dimethylstyrene, p-n -butylstyrene, p-dodecylstyene, p-methoxystyrene, p-phenylstyrene, and p-chlorostyrene.

The styrene-butadiene elastomer has a number average molecular weight Mn within a range of, preferably, 1,000 to 100,000 (see Formula 1) and more preferably 2,000 to 50,000, in a molecular weight distribution measured using a GPC (gel permeation chromatography). A weight-average molecular weight Mw of the styrene-butadiene elastomer is, within a range of, preferably, 5,000 to 1,000,000 and more preferably 10,000 to 500,000. In this case, at least one peak is present within the weight-average molecular weight Mw range of 2,000 to 200,000 and preferably within the weight-average molecular weight Mw range of 3,000 to 150,000.

In the styrene-butadiene elastomer, the value of (weight -average molecular weight Mw/number average molecular weight Mn) ratio is preferably equal to or lower than 3.0, and more preferably equal to or lower than 2.0.

The content of styrene within the styrene-butadiene elastomer (the content of the polymer block A) is within a range of, preferably, 5 to 75 mass % (see Formula 2) and more preferably 10 to 65 mass %. When the styrene content is less than 5 mass %, the glass transition temperature of a film of the styrene elastomer becomes excessively low, deteriorating the film formation properties of the styrene elastomer. When the styrene content exceeds 75 mass %, the softening point of the film of the styrene elastomer becomes excessively high, lowering fixation properties of the pigments, that is, fixation properties of images by the film of the styrene elastomer.

In the present embodiment, a commercially available styrene elastomer can be used. For example, "Kraton" manufactured by Shell, "Asaprene™" T411, T413, T437, "Tufprene™" A, 315P, which are manufactured by Asahi Kasei Chemicals Corporation, and "JSR TR1086," "JSR TR2000," "JSR TR2250" and "JSR TR2827" manufactured by JSR Corporation can be used as a styrene-conjugated diene block copolymer. Furthermore, "Septon" S1001, S2063, S4055, S8007, "Hybrar" 5127, 7311, which are manufactured by Kuraray Co., Ltd., and "Dynaron" 6200P, 4600P, 1320P manufactured by JSR Corporation can be used as a hydrogenated product of the styrene-conjugated diene block copolymer. Also, "Index" manufactured by The Dow Chemical Company can be used as a styrene-ethylene copolymer. As a composition, "Aron AR" manufactured by Aronkasei Co., Ltd. and "Rabalon" manufactured by Mitsubishi Chemical Corporation can be used. These materials can be used alone or in combinations of two or more types thereof.

(Cellulose Ether)

Cellulose ether is a polymer formed by substituting a hydroxyl group of a cellulose molecule with an alkoxy group. The substitution rate is preferably 45 to 49.5%. The alkyl moiety of the alkoxy group may be substituted with, for example, hydroxyl group or the like. A film formed by cellulose ether is excellent in toughness and thermal stability.

The conditions for the cellulose ether that can be used in the present embodiment are: the cellulose ether can stably exist in a dissolved state in the carrier liquid for a long period of time; and the cellulose ether can accumulate and then form a film on a surface of a sheet when the concentration of the cellulose ether within the carrier liquid increases and consequently exceeds the saturated amount of the dissolved cellulose ether on the surface of the sheet after the image is transferred to the sheet. Thus, examples of the cellulose ether that can be used in the present embodiment include: alkyl cellulose such as methylcellulose and ethylcellulose; hydroxyalkyl cellulose such as hydroxyethyl cellulose and hydroxypropyl cellulose; hydroxy alkyl alkyl cellulose such as hydroxyethyl methyl cellulose, hydroxypropyl methyl cellulose, and hydroxyethyl ethyl cellulose; carboxy alkyl cellulose such as carboxymethyl cellulose; and carboxy-alkyl hydroxy-alkyl cellulose such as carboxymethyl hydroxyethyl cellulose. These cellulose ethers may be used alone or in combinations of two or more thereof, depending on the circumstances. Of these cellulose ethers, alkyl celluloses are preferred. Of these alkyl celluloses, ethyl celluloses are preferred.

In the present embodiment, a commercially available cellulose ether can be used. Examples thereof include "Ethocel™ STD4," "Ethocel™ STD7," and "Ethocel™ STD10" manufactured by Nissin-Kasei Co., Ltd. These ethyl celluloses may be used alone or in combinations of two or more thereof, depending on the circumstances.

(Polyvinyl Butyral)

The polyvinyl butyral that can be used in the present embodiment (butyral resin: alkyl acetalized polyvinyl alcohol) is, as shown in Formula 3, a copolymer of a hydrophilic vinyl alcohol unit having a hydroxyl group, a hydrophobic vinyl acetal unit having a butyral group, and a vinyl acetate unit having an intermediate property between a vinyl alcohol unit and vinyl acetal unit and having an acetyl group. Polyvinyl butyral which has a degree of butyralization (the ratio between a hydrophilic moiety and a hydrophobic moiety) between 60 to 85 mol % is preferred in the liquid developer of the present embodiment in terms of its excellent film formation properties (film formation properties). The polyvinyl butyral has a vinyl acetal unit indicating the solubility of the polyvinyl butyral for a nonpolar solvent and a vinyl alcohol unit for improving the bonding properties of the recording medium such as a paper sheet. Therefore, the polyvinyl butyral has high affinity with both the carrier liquid and the recording medium.

(CHEMICAL FORMULA 3)

[C3]

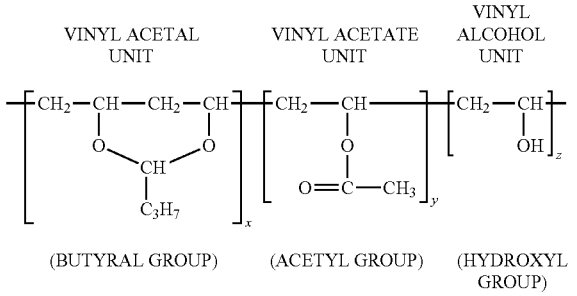

The polyvinyl butyral that can be used in the present embodiment is not particularly limited. Examples thereof include "Mowital™" B20H, B30B, B30H, B60T, B60H, B60HH and B70H manufactured by Hoechst AG; "S-LEC™" BL-1 (degree of butyralization: 63±3 mol %), BL-2 (degree of butyralization: 63±3 mol %), BL-S (degree of butyralization: 70 mol % or more), BL-L, BH-3 (degree of butyralization: 65±3 mol %), BM-1 (degree of butyralization: 65±3 mol %), BM-2 (degree of butyralization: 68±3 mol %), BM-5 (degree of butyralization: 63±3 mol %) and BM-S, manufactured by Sekisui Chemical Co., Ltd.; and "Denka butyral" #2000-L, #3000-1, #3000-2, #3000-3, #3000-4, #3000-K, #4000-1, #5000-A, and #6000-C manufactured by Denki Kagaku Kogyo KK. These polyvinyl butyrals may be used alone or in combinations of two or more thereof.

[Manufacturing Method]

The liquid developer according to the present embodiment can be produced by sufficiently dissolving or mixing/dispersing the carrier liquid, pigments, organic polymer compounds and, depending on the situation, the dispersion stabilizer for several minutes to over 10 hours, depending on the situation, by using, for example, a ball mill, sand grinder, Dyno mill, rocking mill or the like (or a media distributed machine using zirconia beads and the like may be used).

Mixing/dispersing these components pulverize the pigments into fine pieces. The mixing/dispersion time and the rotating speed of the machine to be used are adjusted so that the average particle diameter ($D_{50}$) of the pigments within the liquid developer becomes, preferably, 0.1 to 1.0 μm as described above. When the dispersion time is excessively short or when the rotating speed is excessively low, the average particle diameter of the pigments ($D_{50}$) exceeds 1.0 μm, deteriorating the fixation properties as described above. When the dispersion time is excessively long or when the rotating speed is excessively high, the average particle diameter of the pigments ($D_{50}$) becomes less than 0.1 μm, leading to poor developing properties, resulting in low image density and high risk of fogging.

In the present embodiment, the liquid developer may be produced by dissolving the organic polymer compounds in the carrier liquid and then mixing/dispersing the pigments (along with the dispersion stabilizer, depending on the situation). The liquid developer may also be produced by preparing a resin solution (obtained by dissolving the organic polymer compounds in the carrier liquid) and a pigment dispersion (obtained by mixing/dispersing the pigments in the carrier liquid (along with the dispersion stabilizer, depending on the situation)), and then mixing the resin solution with the pigment dispersion at an appropriate mixing ratio (mass ratio).

A particle size distribution needs to be measured in order to calculate the average particle diameter ($D_{50}$) of the pigments. The particle size distribution of the pigments can be measured as follows. For example, a predetermined amount of produced liquid developer or prepared pigment dispersion is sampled and diluted to 10 to 100 times of its volume with the same carrier liquid as the one used in the liquid developer or the pigment dispersion. The particle size distribution of thus obtained liquid is measured based on a flow system using a laser diffraction type particle size distribution measuring device "Mastersizer 2000" manufactured by Malvern Instruments Ltd.

The viscosity of the produced liquid developer can be measured at a measurement temperature of 25° C. by using a vibrational viscometer "Viscomate VM-10A-L" manufactured by CBC Co., Ltd.

<Liquid Developing Device and Image Forming Apparatus>

Next, the liquid developing device and the wet image forming apparatus according to the present embodiment are described with reference to the drawings. The terms indicating the directions such as "upper," "lower," "left" and "right" in the following description are merely for clarification and do not intend to limit the present disclosure in any way. The term "sheet" in the following description denotes a variety of recording media on which images can be formed, such as, for example, high quality plain paper, printing paper, copy paper, tracing paper, cardboard, and OHP sheets.

Figure 2:
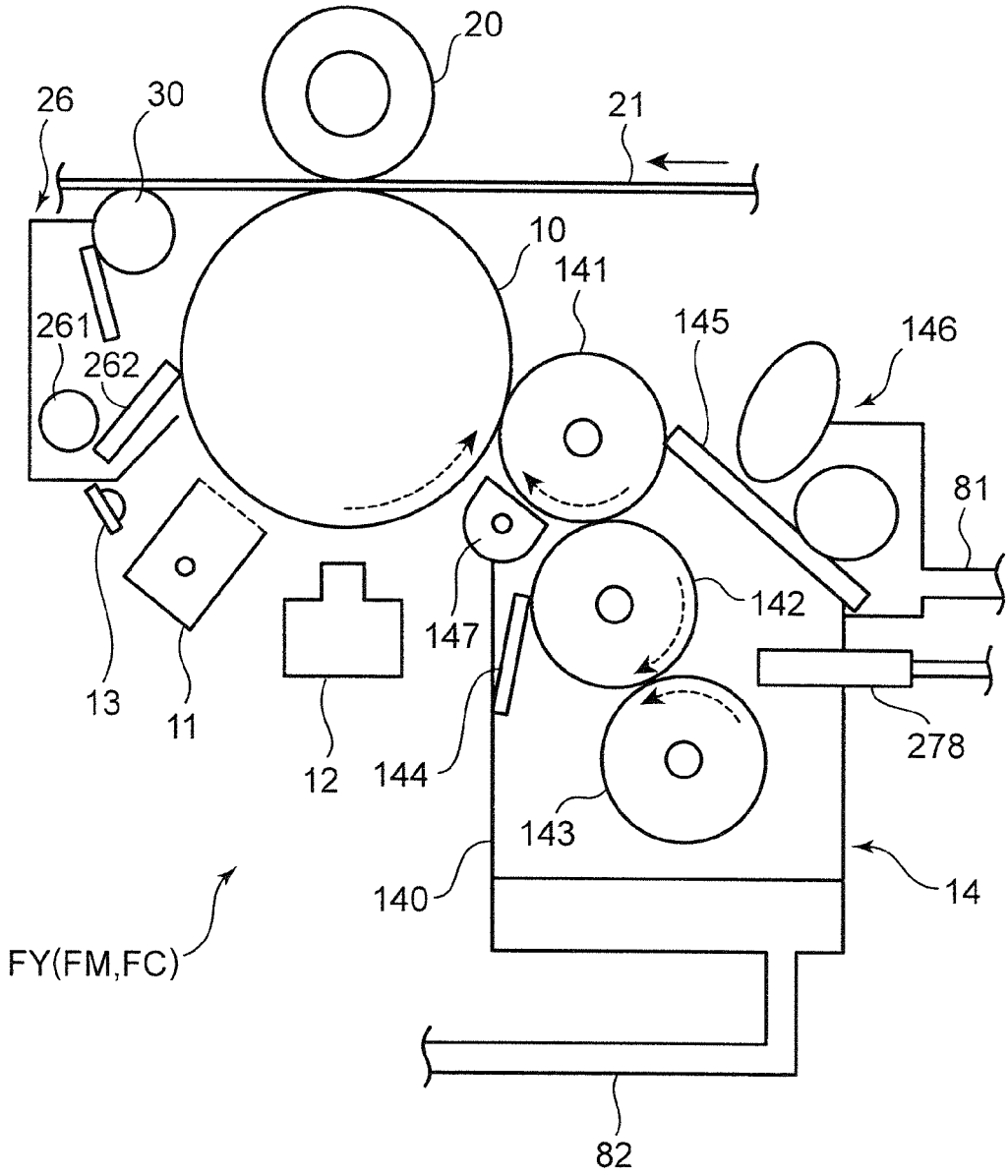
FIG. 2 is a schematic configuration diagram showing a liquid developing device and the periphery thereof of the wet image forming apparatus shown in FIG. 1.

FIG. 1 is a schematic configuration diagram of the wet image forming apparatus according to the present embodiment. FIG. 2 is a schematic configuration diagram showing the liquid developing device of the wet image forming apparatus and its periphery shown in FIG. 1. Note that the wet image forming apparatus according to the present embodiment is a color printer; however, it could be any type of wet image forming apparatus capable of forming images on sheets or recording media, such as, for example, a black-and-white printer, a copy machine, a facsimile machine, or a multi-functional peripheral having these functions.

As shown in FIG. 1, a wet image forming apparatus 1A according to the present embodiment has a variety of units and parts used for forming images. The image forming apparatus 1A further has yellow (Y), magenta (M), cyan (C) and black (Bk) liquid developer circulators below what is shown in FIG. 1, but the illustration thereof is omitted.

The wet image forming apparatus 1A has a tandem type image forming part 2 for forming an image based on image data, a sheet accommodating part 3 for accommodating the sheets, a secondary transfer part 4 for transferring the image formed by the image forming part 2 onto the sheets, a discharge part 6 for discharging the sheets to the outside of the apparatus after the image is completely fixed thereon, and a sheet conveying part 7 for conveying the sheets from the sheet accommodating part 3 to the discharge part 6.

In a general wet image forming apparatus, normally a fixing part 5 for fixing the transferred image onto each sheet (the fixing part 5 has a heating roller 51 and a pressure roller 52 that are disposed to face each other so as to convey the sheet therebetween) is disposed between the secondary transfer part 4 and the discharge part 6. The wet image forming apparatus 1A of the present embodiment, however, may not have such a fixing part, and, instead, may simply have sheet conveying rollers 8, 8. In other words, the wet image forming apparatus 1A according to the present embodiment is capable of fixing the transferred image onto the sheet by using the abovementioned liquid developer of the present embodiment, without requiring the fixing part. Therefore, since the wet image forming apparatus 1A does not require the fixing part 5 that consumes thermal or light energy as in the prior art, simplification and cost-cutting of the wet image forming apparatus 1A can be realized.

The image forming part 2 has an intermediate transfer belt 21, a cleaning unit 22 for cleaning the intermediate transfer belt 21, and image forming units FY, FM, FC and FB corresponding to the colors of yellow (Y), magenta (M), cyan (C), and black (Bk).

The intermediate transfer belt 21, an electrically conductive and wide endless belt member, is driven to circulate in a clockwise direction in FIG. 1. In the drive circulation of the intermediate transfer belt 21, the surface facing the outside is described as "front surface," and the surface facing the inside is described as "rear surface."

The image forming units FY, FM, FC and FB are disposed side by side along a lower running surface of the intermediate transfer belt 21. The order of the image forming units FY, FM, FC and FB is not limited to the one illustrated in FIG. 1, but the arrangement shown in FIG. 1 is a preferred example from the perspective of minimizing the influence of color mixture on a completed image.

Each of the image forming units FY, FM, FC and FB has a photoreceptor drum 10, a charger 11, an LED exposure device 12, a liquid developing device 14, a primary transfer roller 20, a cleaning device 26, a destaticizing device 13, and a carrier liquid removing roller 30. Note that the black image forming unit FB located closest to the secondary transfer part 4 is not provided with the carrier liquid removing roller 30, but the rest of its configuration is same as those of the other image forming units.

A surface (circumferential surface) of the cylindrical photoreceptor drum 10 is capable of carrying an image rendered by charged colored particles (charged to a positive polarity in the present embodiment). The photoreceptor drums 10 shown in the diagram are capable of rotating in a counterclockwise direction.

The charger 11 uniformly charges the surface of the photoreceptor drum 10. Operations of the charger 11 configure a charging step.

The LED exposure device 12 has LEDs as light sources to emit light beams to the uniformly charged surface of the photoreceptor drum 10, based on the image data input from external equipment. As a result, an electrostatic latent image based on the image data is formed on the surface of the photoreceptor drum 10. Operations of the exposure device 12 configure an exposure step.

The liquid developing device 14 holds the liquid developer having the electrically insulating carrier liquid and the colored particles dispersed in the carrier liquid, so as to face the electrostatic latent image formed on the surface of the photoreceptor drum 10. Accordingly, the electrostatic latent image on the surface of the photoreceptor drum 10 is developed (rendered) to a toner image by the charged colored particles. Operations of the liquid developing device 14 configure a developing step. Note that the liquid developing device 14 and the wet image forming apparatus 1A according to the present embodiment use the abovementioned liquid developer.

As shown in FIG. 2, the liquid developing device 14 includes a developer container 140, a developing roller 141, a feed roller (anilox roller) 142, a supporting roller 143, a feed roller blade 144, a developer cleaning blade 145, a developer recovery device 146, and a developing roller charger 147.

The developer container 140 into which the liquid developer is fed accumulates the liquid developer therein. The liquid developer, obtained after the concentrations of the carrier liquid and the colored particles are adjusted, is fed from a feed nozzle 278 into the developer container 140. In this case, the liquid developer is fed toward a nip between the feed roller 142 and the supporting roller 143, and an excess of the liquid developer drops below the supporting roller 143 and accumulates in a bottom part of the developer container 140. The accumulated liquid developer is recovered through a pipe 82 and prepared for reproduction/reuse.

The supporting roller 143, disposed substantially in the middle of the developer container 140, comes into abutment from below, against the feed roller 142, to form the nip therebetween. The feed roller 142 is not disposed immediately above the supporting roller 143 but shifted in a direction to separate from the feed nozzle 278. A circumferential surface of the feed roller 142 is provided with a groove for holding the liquid developer. The supporting roller 143 rotates in the counterclockwise direction and the feed roller 142 rotates in the clockwise direction, as shown by the dotted arrows in the diagram.

The liquid developer fed from the feed nozzle 278 is temporarily accumulated on the upstream side of the direction of rotation of the supporting roller 143 at the nip between the feed roller 142 and the supporting roller 143, and then delivered upward while being held in the groove of the feed roller 142 as the rollers 142 and 143 rotate. The feed roller blade 144 is brought into press-contact with the circumferential surface of the feed roller 142 to regulate the amount of liquid developer held in the groove of the feed roller 142, to a predetermined amount. The excess liquid developer that is scraped off by the feed roller blade 144 accumulates in the bottom part of the developer container 140.

The developing roller 141 is disposed at an upper opening part of the developer container 140, in a manner that the developing roller 141 is contact with the feed roller 142. The developing roller 141 is rotated in the same direction as the feed roller 142. As a result, the surface of the developing roller 141 moves in a direction opposite to the surface of the feed roller 142 at a nip where the developing roller 141 is in abutment with the feed roller 142. Therefore, the liquid developer held on the circumferential surface of the feed roller 142 is delivered to the circumferential surface of the developing roller 141. Because the amount of liquid developer held in the groove of the feed-roller 142 (the thickness of a liquid developer layer) is regulated to the predetermined amount, the amount of liquid developer carried on the surface of the developing roller 141 (the thickness of the liquid developer layer) is also kept at a predetermined value.

The developing roller charger 147 provides bias potential having the same polarity as a charged polarity of the colored particles (a bias potential having the positive polarity, in the present embodiment), from an external surface side to the developing roller 141 (developing corona charge), so as to move the colored particles in the liquid developer layer carried on the surface of the developing roller 141, to the surface side of the developing roller 141. As a result, the colored particles within the liquid developer layer are collected/compressed on the developing roller 141 side by an electric field action (compaction process), forming a layer of highly-concentrated colored particles on the developing roller 141 side. Thereafter, the liquid developer layer is fed to the photoreceptor drum 10, and the electrostatic latent image is developed on the photoreceptor drum 10. Consequently, the developing efficiency is improved, forming a high-resolution image. The developing roller charger 147 is provided so as to face the circumferential surface of the developing roller 141 on the downstream side of the direction of rotation of the developing roller 141 from a contact portion between the developing roller 141 and the feed roller 142, and on the upstream side of the direction of rotation of the developing roller 141 from a contact portion between the developing roller 141 and the photoreceptor drum 10. In other words, the developing roller charger 147 generates an electric field through the developing corona charge. Consequently, the liquid developer layer on the developing roller 141 is divided into the colored particle layer on the surface of the developing roller 141 and a carrier liquid layer on the colored particle layer. In a developing region (a region where the developing roller 141 and the photoreceptor drum 10 are in face contact with each other, and a peripheral region thereof), the divided liquid developers layer on the developing roller 141 come into contact with the surface of the photoreceptor drum 10. At this moment, the collected/compressed colored particles on the developing roller 141 side move from the surface of the developing roller 141 to the surface of the photoreceptor drum 10 according to the principle of electrophoresis, in order to render the electrostatic latent image on the surface of the photoreceptor drum 10 into an image. Because the colored particles within the liquid developer layer on the developing roller 141 are compressed on the surface of the developing roller 141 (compaction process) as a result of the developing corona charge performed by the developing roller charger 147, the colored particles do not come into contact with photoreceptor drum 10 at a non-image region on the photoreceptor drum 10, preventing the occurrence of fogging in image formation. In addition, as a result of forming an electric field through the developing corona charge, an electric charge is injected into the colored particles within the liquid developer layer on the developing roller 141. A development electric field develops the electrostatic latent image on the photoreceptor drum 10 with satisfactory response by using the colored particles. Moreover, the colored particles electrostatically and, tightly adhere to an image area on the surface of the photoreceptor drum 10.

The developing roller 141 comes into contact with the photosensitive drum 10, whereby the toner image based on the image data is formed on the surface of the photoreceptor drum 10 by a difference in potential between the electrostatic latent image on the surface of the photoreceptor drum 10 and the development electric field applied to the developing roller 141.

The developer cleaning blade 145 is disposed in contact with the downstream side of the direction of rotation of the developing roller 141 from the contact portion between the developing roller 141 and the photoreceptor drum 10. The developer cleaning blade 145 removes the liquid developer on the surface of the developing roller 141 after the electrostatic latent image on the photoreceptor drum 10 is developed.

The developer recovery device 146 recovers the liquid developer removed by the developer cleaning blade 145 and delivers the liquid developer to a pipe 81 of each liquid developer circulator. The liquid developer flows downward along the surface of the developer cleaning blade 145. Due to the high viscosity of the liquid developer, the developer recovery device 146 is provided with delivery rollers for assisting in delivering the liquid developer.

The primary transfer roller 20 is disposed on the rear surface of the intermediate transfer belt 21 so as to face the photoreceptor drum 10. Voltage having a polarity opposite to that of the colored particles within the image is applied from a power source (not shown) to the primary transfer roller 20. At a position where the primary transfer roller 20 is in contact with the intermediate transfer belt 21, the primary transfer roller 20 applies, to the intermediate transfer belt 21, the voltage having the polarity opposite to that of the colored particles. The colored particles are attracted to the front surface of the intermediate transfer belt 21 and its periphery by this applied voltage. In other words, the image that is developed on the surface of the photoreceptor drum 10 is transferred to the intermediate transfer belt 21. The intermediate transfer belt 21 functions as an image carrier for carrying an image thereon and conveying it to a sheet.

According to the wet image forming apparatus of the present embodiment, the use of the abovementioned liquid developer of the present embodiment can prevent the liquid developer from accumulating in the nip between the photoreceptor drum and the intermediate transfer body, thereby preventing the occurrence of bleeding during image formation.

The cleaning device 26 is a device for cleaning the liquid developer that remains on the photoreceptor drum 10 without being transferred from the photoreceptor drum 10 to the intermediate transfer belt 21. The cleaning device 26 has a residual developer conveying screw 261 and a cleaning blade 262. The residual developer conveying screw 261 disposed within the cleaning device 26 conveys the residual developer to the outside of the cleaning device 26, the residual developer being scraped off the photoreceptor drum 10 by the cleaning blade 262 and then stored in the cleaning device 26.

The plate-like cleaning blade 262 extends in a direction of a rotation axis of the photoreceptor drum 10 so as to scrape the liquid developer remaining on the surface of the photoreceptor drum 10. One end portion of the cleaning blade 262 is in sliding contact with the surface of the photoreceptor drum 10 so as to scrape the residual liquid developer on the photoreceptor drum 10 as the photoreceptor drum 10 rotates.

In preparation for the image formation in the next cycle, the destaticizing device 13 with destaticizing light sources destaticizes the surface of the photoreceptor drum 10 using lights of the light sources, after the liquid developer is removed by the cleaning blade 262.

The substantially cylindrical carrier liquid removing roller 30 is capable of rotating about a rotation axis thereof parallel to the rotation axis of the photoreceptor drum 10, in the same direction as the photoreceptor drum 10. The carrier liquid removing roller 30 is disposed on the secondary transfer part 4 side with respect to the position where the photoreceptor drum 10 and the intermediate transfer belt 21 are in contact with each other. The carrier liquid removing roller 30 removes the carrier liquid from the front surface of the intermediate transfer belt 21.

The sheet accommodating part 3 shown in FIG. 1 accommodates the sheets on which the image is fixed and formed. The sheet accommodating part 3 is disposed in a lower part of the wet image forming apparatus 1A. The sheet accommodating part 3 also has a paper cassette (not shown) that is formed so as to be able to accommodate the sheets.

The secondary transfer part 4 transfers the image formed on the intermediate transfer belt 21, to each of the sheets. The secondary transfer part 4 has a supporting roller 41 for supporting the intermediate transfer belt 21 and a secondary transfer roller 42 disposed so as to face the supporting roller 41. Note in the present embodiment that the secondary transfer part 4, the intermediate transfer belt 21, and the primary transfer roller constitute a transfer device. Operations of the secondary transfer part 4, operations of the intermediate transfer belt 21, and operations of the primary transfer roller 20 constitute a transfer step.

In place of the fixing part 5, the conveying rollers 8, 8 may be provided above the secondary transfer part 4, as described above.

The sheet conveying part 7 having a plurality of pairs of conveying rollers is for conveying the sheets from the sheet accommodating part 3 to the discharge part 6 via the secondary transfer part 4. After the transfer of the image, the sheet having the image fixed thereon completely is discharged from the discharge part 6 that is provided on an upper part of the wet image forming apparatus 1A. Operations of the discharge part 6 for discharging the sheet to which the image is transferred constitute a discharge step.

<Wet Image Forming Method>

Forming the image on the sheet by using the wet image forming apparatus 1A accomplishes the wet image forming method according to the present embodiment. The wet image forming method according to the present embodiment includes: the charging step of charging the surface of the photoreceptor drum 10; the exposure step of forming the electrostatic latent image on the charged surface of the photoreceptor drum 10; the developing step of developing the electrostatic latent image on the surface of the photoreceptor drum 10 by using a liquid developer that includes an electrically insulating carrier liquid, colored particles dispersed within the carrier liquid, and an organic polymer compound, and has a viscosity of 30 to 400 mPa·s (at a measurement temperature of 25° C.); the transfer step of transferring the developed image to the sheet; and the discharge step of discharging the sheet having the image transferred thereto, from the discharge part 6. According to the wet image forming method of the present embodiment, the use of the above mentioned liquid developer can prevent the occurrence of bleeding during image formation and obtain high-quality images.

EXAMPLES

The present disclosure is now described hereinafter in more detail using examples, but the present disclosure is not limited by the following examples.

1. Manufacturing the Liquid Developer (Liquid Developers a to E, G to K)

A cyan pigment (C.I. Pigment Blue 15:3) in an amount of 20 parts by mass, serving as the colored particles, and "Antaron™ V -216" (manufactured by ISP Corporation) in an amount of 8 parts by mass, serving as the dispersion stabilizer, were mixed/dispersed in a liquid paraffin in an amount of 72 parts by mass ("Moresco White P-55" manufactured by Matsumura Oil Co., Ltd.), serving as a carrier liquid 1, by using a rocking mill (RM-10 manufactured by Seiwa Giken Co., Ltd.) at a drive frequency of 60 Hz at room temperature) (25 C.°) for one hour, in order to prepare a high-concentration pigment dispersion. Note that heat was generated in this mixing/dispersion process, but the temperature was not adjusted. The average particle diameter ($D_{50}$) of the pigment within the pigment dispersion was 0.5 μm.

Next, each of the organic polymer compounds (resin) in an amount of 15 parts by mass shown in Table 1 below was stirred, mixed and dissolved in each of the resin solution solvents in an amount of 85 parts by mass shown in Table 1 below, by using a stirring device (Tornado SM-102 manufactured by As One Corporation) (room temperature (25 C.°), rotating speed: 800 rpm, time: 30 minutes), in order to obtain a resin solution. When a carrier liquid different than the carrier liquid 1 was used, this different liquid carrier was denoted as "carrier liquid 2" in Table 1. Specifically, the carrier liquid 1 and the carrier liquid 2 in the present example indicate a first type of carrier liquid (carrier liquid 1) and a second type of carrier liquid (carrier liquid 2) used in the respective liquid developers.

TABLE 1

Mixing ratio and names of raw materials of resins and solvents

| | | Resins | Resin solutions | Product names of resins | Solvents of resin solutions | Product names of solvents of resin solutions |
|---|---|---|---|---|---|---|
| Example 1 | Liquid developer A | 15 | 85 | TOPAS TM | Carrier 1 | Moresco White P-55 |
| Example 2 | Liquid developer B | 15 | 85 | TOPAS TM | Carrier 1 | Moresco White P-55 |
| Example 3 | Liquid developer C | 15 | 85 | Asaprene T413 | Carrier 2 | Vege-Sol CM |
| Example 4 | Liquid developer D | 15 | 85 | Asaprene T413 | Carrier 2 | Vege-Sol CM |
| Example 5 | Liquid developer E | 15 | 85 | Ethocel STD4 | Carrier 2 | Hartall FA-1 |
| Comparative Example 1 | Liquid developer G | 15 | 85 | TOPAS TM | Carrier 1 | Moresco White P-55 |
| Comparative Example 2 | Liquid developer H | 15 | 85 | TOPAS TM | Carrier 1 | Moresco White P-55 |
| Comparative Example 3 | Liquid developer I | 15 | 85 | Asaprene T413 | Carrier 2 | Vege-Sol MT |
| Comparative Example 4 | Liquid developer J | 15 | 85 | Asaprene T413 | Carrier 2 | Vege-Sol MT |
| Comparative Example 5 | Liquid developer K | — | — | — | — | — |

Subsequently, each of the obtained resin solutions, the high-concentration pigment dispersion, and an additional carrier liquid were stirred and mixed at each of mixing ratios shown in Table 2 below, by using the stirring device (Tornado SM-102 manufactured by As One Corporation) (room temperature (25 C.°), rotating speed: 800 rpm, time: 30 minutes), in order to obtain liquid developers A to E (Examples 1 to 5) and liquid developers G to K (comparative examples 1 to 5).

TABLE 2

| Method for preparing the developers (high-concentration pigment dispersion + resin solution + additional carrier) | | | | | | |
|---|---|---|---|---|---|---|
| | | Compounding Ratio (parts by mass) | | | | |
| | | High-Concentration Pigment Dispersant | Resin solutions | Additional Carriers | Additional Carriers | Product names of additional carriers |
| Example 1 | Liquid developer A | 20 | 6.7 | 73.3 | Carrier 1 | Moresco White P-55 |
| Example 2 | Liquid developer B | 25 | 66.7 | 8.3 | Carrier 1 | Moresco White P-55 |
| Example 3 | Liquid developer C | 20 | 6.7 | 73.3 | Carrier 1 | Moresco White P-55 |
| Example 4 | Liquid developer D | 25 | 63.3 | 11.7 | Carrier 1 | Moresco White P-55 |
| Example 5 | Liquid developer E | 25 | 21.5 | 53.5 | Carrier 1 | Moresco White P-55 |
| Comparative Example 1 | Liquid developer G | 20 | 3.3 | 76.7 | Carrier 1 | Moresco White P-55 |
| Comparative Example 2 | Liquid developer H | 25 | 73.3 | 1.7 | Carrier 1 | Moresco White P-55 |
| Comparative Example 3 | Liquid developer I | 20 | 3.3 | 76.7 | Carrier 1 | Moresco White P-55 |
| Comparative Example 4 | Liquid developer J | 25 | 70 | 5 | Carrier 1 | Moresco White P-55 |
| Comparative Example 5 | Liquid developer K | 25 | 0 | 75 | Carrier 2 | Moresco White P-200 |

(Liquid Developer F)

Polyvinyl butyral ("S-LEC™ BL-1" manufactured by Sekisui Chemical Co., Ltd.) in an amount of 3.8 parts by mass was dissolved in castor oil (castor oil "LAV" manufactured by Ito Oil Chemicals Co., Ltd.) in an amount of 36.5 parts by mass, serving as a carrier liquid, in order to prepare a resin solution. The obtained resin solution in an amount of 40.3 parts by mass and the cyan pigment (C.I. Pigment Blue 15:3) in an amount of 5 parts by mass, serving as the colored particles, were mixed/dispersed in a vegetable oil-based solvents "Vege-Sol™ MT" in an amount of 54.7 parts by mass, manufactured by Kaneda Co., Ltd., by using the rocking mill (RM-10 manufactured by Seiwa Giken Co., Ltd.) at a drive frequency of 60 Hz for one hour (at room temperature 25 C.°. Heat was generated but the temperature was not adjusted), in order to prepare a liquid developer F (Example 6). The average particle diameter ($D_{50}$) of the pigments within the liquid developer F was 0.4 μm.

Table 3 shows the compounding ratios (mass %) among the pigments, dispersion, organic polymer compounds and carrier liquid in each of the liquid developers A to K obtained as described above. Carrier liquid 1 and carrier liquid 2 shown in Table 3 correspond to the carrier liquid 1 and the carrier liquid 2 shown in Tables 1 and 2.

TABLE 3

| | | Pigments | Dispersants | Organic polymer compounds | Carrier liquid 1 | Carrier liquid 2 | Viscosity (mPa · s) | Bleeding |
|---|---|---|---|---|---|---|---|---|
| Example 1 | Liquid developer A | 4 | 1.6 | 1 | 93.4 | 0 | 32 | ○ |
| Example 2 | Liquid developer B | 5 | 2 | 10 | 83 | 0 | 367 | ○ |
| Example 3 | Liquid developer C | 4 | 1.6 | 1 | 87.7 | 5.7 | 34 | ○ |
| Example 4 | Liquid developer D | 5 | 2 | 9.5 | 29.7 | 53.8 | 394 | ○ |
| Example 5 | Liquid developer E | 5 | 2 | 3.2 | 71.5 | 18.3 | 107 | ○ |
| Example 6 | Liquid developer F | 5 | 0 | 3.8 | 36.5 | 21.5 | 117 | ○ |
| Comparative Example 1 | Liquid developer G | 4 | 1.6 | 0.5 | 93.9 | 0 | 24 | X |
| Comparative Example 2 | Liquid developer H | 5 | 2 | 11 | 82 | 0 | 412 | X |
| Comparative Example 3 | Liquid developer I | 4 | 1.6 | 0.5 | 91.1 | 2.8 | 27 | X |
| Comparative Example 4 | Liquid developer J | 5 | 2 | 10.5 | 23 | 59.5 | 432 | X |
| Comparative Example 5 | Liquid developer K | 5 | 2 | 0 | 18 | 75 | 102 | X |

2. Evaluation of Liquid Developers (Measuring the Viscosities of the Liquid Developers)

Each of the liquid developers in an amount of 15 ml was placed in a 20-ml container to measure its viscosity by using a vibrational viscometer (Viscomate VM-10A-L manufactured by CBC Co., Ltd.) in an environment of 25° C. The results are shown in Table 3.

(Image Formation)

By using the wet image forming apparatus (color printer) 1A without the fixing part (an experimental machine of a wet image forming apparatus manufactured by Kyocera Mita Corporation, with linear speed of 116 mm/s), shown in FIG. 1, the cyan liquid developers A to K are poured into the cyan image forming unit FC, and a square solid image (5 cm×5 cm) was formed on a sheet of printing paper (paper for wet development "EP-L": 128 g/m$^2$, manufactured by Mitsubishi Paper Mills Limited) by uniformly applying the pigments in an amount of 0.026 mg/cm$^2$. In so doing, the thickness of the liquid developer layer on the circumferential surface of the developing roller 141 was set at 6 μm. In addition, a development voltage to be applied to the developing roller 141 when forming the image on the surface of the photoreceptor drum 10 based on the image data was set at 400 V. The sheet discharged from the discharge part 6 was subjected to image evaluation. The other image formation conditions are as follows:

Bias potential for the developing corona charge performed by the developing roller charger 147: 4000 V The intermediate transfer belt 21: made of polyimide Dark potential of the photoreceptor drum 10: +500 V Light potential of the photoreceptor drum 10: +10 V Primary transfer voltage of the primary transfer roller 20: 300 V (constant voltage control)

Secondary transfer current of the secondary transfer part 4: 40 μA (constant current control)

(Evaluation of Bleeding in Image)

The solid image is formed on the intermediate transfer belt (the drive of the experimental machine is stopped prior to secondary transfer). A piece of tape (Mending tape (CAT. NO. 810-1-18) manufactured by 3M) is pasted to a boundary section between an image area and a non-image area in a rear end part of the solid image. The tape is pressed with a finger to transfer the image on the intermediate transfer belt to the tape. Then, the tape is pasted on a sheet of white paper (paper for wet development "EP -L":128 g/m$^2$, manufactured by Mitsubishi Paper Mills Limited) to visually observe the boundary section between the image area and the non-image area. When the contrast of the boundary section between the image area and the non-image area is clear, the result is then marked by "o." When the contrast is blurry, the result is then marked by "x." When the contrast is not clear and makes the image look like it is rubbed, then the result is also marked by "x."

The results are shown in Table 3.

3. Review of The Results

As is clear from Table 3, no bleeding occurred with the liquid developers A to F (Examples 1 to 6), each of which has the pigments dispersed in the carrier liquid, contains the organic polymer compounds and has a viscosity of 30 to 400 m·Pas.

On the other hand, bleeding occurred with the liquid developers G to J (Comparative Examples 1 to 4), each of which has the organic polymer compounds and a viscosity outside the range specified by the present disclosure. Bleeding occurred with the liquid developer K (Comparative Example 5), which does not contain the organic polymer compounds and has a viscosity of 102 mPa·s.

The experiments prove that the use of the liquid developers containing the organic polymer compounds and having a viscosity of 30 to 400 mPa·s can obtain high-quality images with no bleeding.

As described in detail with the specific examples above, when the liquid developer includes the electrically insulating carrier liquid, colored particles dispersed within the carrier liquid and the organic polymer compounds, and has a viscosity of 30 to 400 mPa·s (at a measurement temperature of 25° C.), the viscosity and the tackiness of the liquid section in the non-image area increases because the carrier liquid contains the organic polymer compounds in the non-image area. This increases the amount of carrier liquid passing through the nip between each photoreceptor and the intermediate transfer body, whereby the amount of carrier liquid accumulating before reaching the nip decreases drastically. This can solve the problem of bleeding that occurs when forming images. As a result, high-quality images with no bleeding can be obtained. When the viscosity of the liquid developer is lower than 30 mPa·s, sufficient viscosity and tackiness cannot be achieved in the liquid section of the non-image area, causing the bleeding. When the viscosity of the liquid developer exceeds 400 mPa·s, the viscosity and tackiness of the liquid section of the non-image area become excessively high, forming vertical stripes that make an image look like it is rubbed.

A liquid developer capable of preventing the occurrence of bleeding can be reliably obtained by selecting at least one organic polymer compound from cyclic olefin copolymer, styrene elastomer, cellulose ether, and polyvinyl butyral.

When the liquid developer includes 1 to 10 parts by mass % organic polymer compounds, the occurrence of bleeding during image formation (on formed images) can be prevented, ensuring excellent image developing properties.

More excellent developing properties can be obtained when the carrier liquid has a volume resistivity of $10^{12}$ Ω·cm or above.

When the colored particles are in the form of pigments, the image, transferred to the sheet, can be fixed thereto without requiring the fixing step of using thermal or light energy to fix the image, transferred onto the sheet, which is effective in terms of energy saving. In other words, the organic polymer compounds within the carrier liquid accumulates on a surface of the recording medium and forms a film while coating the pigments accumulated on the surface of the recording medium, and this film formed by the organic polymer compounds fixes the pigments to the recording medium. Therefore, the consumption of the thermal energy or light energy can be eliminated or reduced significantly, and the pigments, or the image, can be fixed to the recording medium with no or low heat. Consequently, the consumption energy of the wet image forming apparatus can be reduced. Moreover, the conventional fixing part that uses thermal or light energy can be eliminated or simplified so as to realize simplification and cost-cutting of the wet image forming apparatus.

In addition, when transferring the liquid developer of the present disclosure to a sheet, the carrier liquid penetrates the image area of the sheet, and the organic polymer compounds precipitate on the surface of the sheet. As a result, the colored particles are fixed to the sheet. When the carrier liquid penetrates the non-image area of the sheet, the organic polymer compounds precipitate on the surface of the sheet. Therefore, the precipitated organic polymer compounds are fixed to the image area and the non-image area of the sheet, preventing the colored particles from being peeled off or the image from being contaminated. Accordingly, high-quality images can be obtained.

A liquid developing device that uses the liquid developer described above is capable of preventing the occurrence of bleeding when forming images (on formed images) and obtaining high-quality images.

A wet image forming method that uses the liquid developer described above is capable of preventing the occurrence of bleeding and obtaining high-quality images.

This application is based on Japanese Patent application No. 2010-121146 filed in Japan Patent Office on May 27, 2010, the contents of which are hereby incorporated by reference.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A liquid developer comprising an organic polymer compound dissolved in an electrically insulating carrier liquid that includes an oil selected from an aliphatic hydrocarbon, a vegetable oil, and a mixture thereof; and a pigment dispersed within the carrier liquid, wherein the organic polymer compound is selected from a cyclic olefin copolymer, a styrene elastomer, a cellulose ether, a polyvinyl butyral, and a mixture thereof;

wherein the liquid developer has a viscosity of 30 to 400 mPa·s at 25° C.

2. The liquid developer according to claim 1, wherein a content of the organic polymer compound in the liquid developer is in the range of 1 to 10 mass %.

3. The liquid developer according to claim 1, wherein the carrier liquid has a volume resistivity of $10^{12}$ □·cm or above.

4. A liquid developing device that develops an electrostatic latent image formed on a surface of a photoreceptor drum using a liquid developer, comprising:

the photoreceptor drum; and the liquid developer;

wherein the liquid developer comprises an organic polymer compound dissolved in an electrically insulating carrier liquid that includes an oil selected from an aliphatic hydrocarbon, a vegetable oil, and a mixture thereof; and a pigment dispersed within the carrier liquid; and wherein the liquid developer has a viscosity of 30 to 400 mPa·s at 25° C.

5. A wet image forming method, comprising the steps of:

charging a surface of a photoreceptor drum;

forming an electrostatic latent image on the charged surface of the photoreceptor drum;

developing the electrostatic latent image on the surface of the photoreceptor drum by using a liquid developer that comprises an organic polymer compound dissolved in an electrically insulating carrier liquid that includes an oil selected from an aliphatic hydrocarbon, a vegetable oil, and a mixture thereof, and a pigment dispersed within the carrier liquid, and the liquid developer has a viscosity of 30 to 400 mPa·s at 25° C.;

transferring the developed image to a recording medium; and discharging the recording medium having the image transferred thereto, from a discharge part.

6. The liquid developer according to claim 1, wherein a content of the oil in the carrier liquid is in a range of 2 to 80 mass %.

7. The liquid developer according to claim 1, wherein a content of the pigment in the liquid developer is in a range of 1 to 30 mass %.

8. The liquid developer according to claim 1, wherein the pigment has a volume basis medium diameter ($D_{50}$) in a range of 0.1 to 1.0 □m.

9. The liquid developer according to claim 1 further comprising about 1 to 10 mass % of a dispersion stabilizer.

10. The liquid developer according to claim 1, wherein the organic polymer is a styrene elastomer.

11. The liquid developer according to claim 10, wherein the styrene elastomer is a block copolymer of an aromatic vinyl compound and a conjugated diene or olefinic compound.

12. The liquid developer according to claim 11, wherein the styrene elastomer is a styrene-butadiene elastomer having a styrene block (polymer block A) and a butadiene block (polymer block B); wherein the styrene-butadiene elastomer has a content of polymer block A in a range from 5 to 75 mass %.

13. The liquid developer according to claim 1, wherein the aliphatic hydrocarbon is a nonvolatile organic solvent.

14. The liquid developer according to claim 1, wherein the aliphatic hydrocarbon is a low volatility organic solvent having a boiling point of 200° C. or higher.

* * * * *